United States Patent [19]

Hatsell

[11] 4,203,677

[45] May 20, 1980

[54] PRINTER RIBBON LIFT ASSEMBLY

[75] Inventor: William A. Hatsell, Hatfield, Pa.

[73] Assignee: Exxon Research & Engineering Co., Florham Park, N.J.

[21] Appl. No.: 833,272

[22] Filed: Sep. 14, 1977

[51] Int. Cl.[2] ..... B41J 33/54

[52] U.S. Cl. ..... 400/214; 400/144.2; 400/208; 400/212; 400/236.1; 400/697.1

[58] Field of Search ..... 400/208, 212, 214, 216.2, 400/697.1, 144.2, 144.3, 236.1

[56] References Cited

U.S. PATENT DOCUMENTS

| | | | |
|---|---|---|---|
| 1,889,315 | 11/1932 | Henderson | 400/212 X |
| 2,135,156 | 11/1938 | Watkins et al. | 400/212 |
| 3,154,185 | 10/1964 | Kamp | 400/214 X |
| 3,397,767 | 8/1968 | Hobbs | 400/697.1 |
| 3,595,362 | 7/1971 | Wolowitz | 400/216.2 |
| 3,645,371 | 2/1972 | Jovis | 400/212 X |
| 3,904,017 | 9/1975 | Frechette | 400/697.1 X |
| 3,905,465 | 9/1975 | Frechette et al. | 400/214 |
| 4,020,940 | 5/1977 | Daley et al. | 400/212 X |
| 4,047,607 | 9/1977 | Willcox | 400/208 |
| 4,047,608 | 9/1977 | Willcox | 400/208 |

*Primary Examiner*—Ernest T. Wright, Jr.
*Attorney, Agent, or Firm*—Norman L. Norris

[57] ABSTRACT

An assembly for elevating the print ribbon and the erase ribbon of an impact printer is disclosed. In their respective rest positions, the ribbons are positioned in vertical relationship to one another and in one embodiment the ribbons are in the same plane when in their rest positions. When the printer is operating in the print mode, the print ribbon is selectively elevated to the print point while the erase ribbon remains stationary. When the printer is operating in the erase mode, both ribbons are elevated. In the erase mode, the print ribbon is elevated to a point above the print point and the erase ribbon is elevated to the print point.

13 Claims, 6 Drawing Figures

PRINTER RIBBON LIFT ASSEMBLY

BACKGROUND OF THE INVENTION

This invention relates in general to impact printers and more particularly it relates to impact printers having a print ribbon and a separate erase ribbon.

In various printers including typewriters such as those manufactured by IBM and SCM, the platen which supports the print receiving medium in the impact printing position remains stationary and the character printing elements move along the platen on a carriage to various printing locations. The character elements may be mounted on a ball or on a wheel oftentimes referred to as a daisy.

In those printers in which the characters are mounted on a ball, the erase ribbon has typically been positioned between the print ribbon and the platen. Thus, when the printer is operated in the print mode, each time a character is formed the print ribbon is elevated from its rest position to its print position while the erase ribbon remains stationary. When the printer is operated in the erase mode, the erase ribbon is raised and the print ribbon remains stationary. While this arrangement operates adequately in printers using a ball type character element, it has not been adaptable to printers using a daisy type character element. The nature of the daisy type character elements is such that they must be positioned closer to the platen than with ball type character elements, and accordingly there is not sufficient clearance to permanently position two ribbons, i.e., both the print and the erase ribbon between the daisy and the platen. Further, even if the erase and print ribbons could be placed in such a side-by-side relationship between the daisy and the platen, this arrangement would tend to increase the distance that the printer's hammer would travel before the daisy would strike the platen. In order that printers can be adaptable to operate at extremely high speed, it is desirable to keep the length of the hammer stroke to a minimum.

Another erase ribbon mounting arrangement is that disclosed in U.S. Pat. No. 3,595,362 to Wolowitz. Disclosed therein is a single print ribbon having two tracks thereon, the top track being the print track and the bottom track being an erase track. While this type of ribbon would eliminate the space disadvantages of using two separate ribbons in a daisy type printer, other disadvantages are presented. For example, the cost of manufacturing ribbon which contains two separate tracks of different types far exceeds the cost of manufacturing separate erase and printer ribbons. Further, since as a general rule, a printer operates in the print mode far more frequently than it operates in the erase mode, large amounts of erase ribbon remain unused when combination print/erase ribbons are used.

SUMMARY OF THE INVENTION

It is an object of the present invention to provide an improved mounting and lifting arrangement for a print ribbon and an erase ribbon for use in a variety of impact printers including printers having a daisy type character element;

It is a further object of the present invention to provide such a mounting and lifting arrangement for print and erase ribbons which is adaptable to high speed operations;

It is still a further object of the present invention to provide a mounting and lifting arrangement for print and erase ribbons for use in such printers which is economical and which eliminates the need for a composite print/erase type ribbon.

These and other objects of the present invention are accomplished by means of a ribbon mounting and lifting arrangement in which the print ribbon and the erase ribbon are separate from one another but mounted in substantially vertical relationship to one another. The present ribbon mounting arrangement is such that when the printer is operated in the print mode only the print ribbon and not the erase ribbon is elevated from the rest position to the operating position at the print point. However, when the printer operates in the erase mode, the erase ribbon is lifted to its operating position at the print point while the print ribbon is lifted to a point above its operating position. The assembly further comprises a means for indexing the erase ribbon such that each time a character is removed from the print receiving medium, when the printer is operating in the erase mode, the erase ribbon is advanced. The present invention will be better understood by reference to the accompanying drawing in which:

DETAILED DESCRIPTION OF A PREFERRED EMBODIMENT

Figure 1:
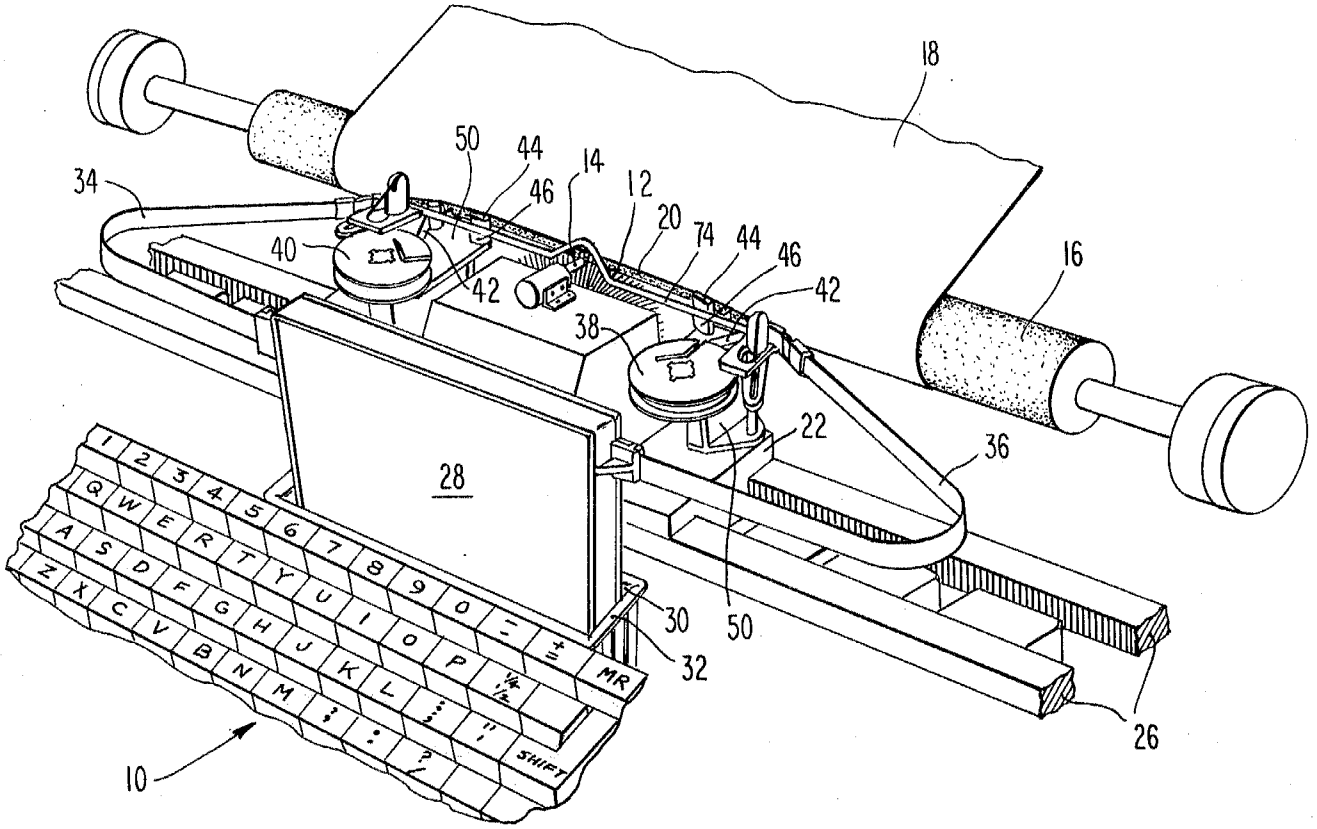
FIG. 1 is a perspective view of a printer incorporating the present invention.
Figure 2:
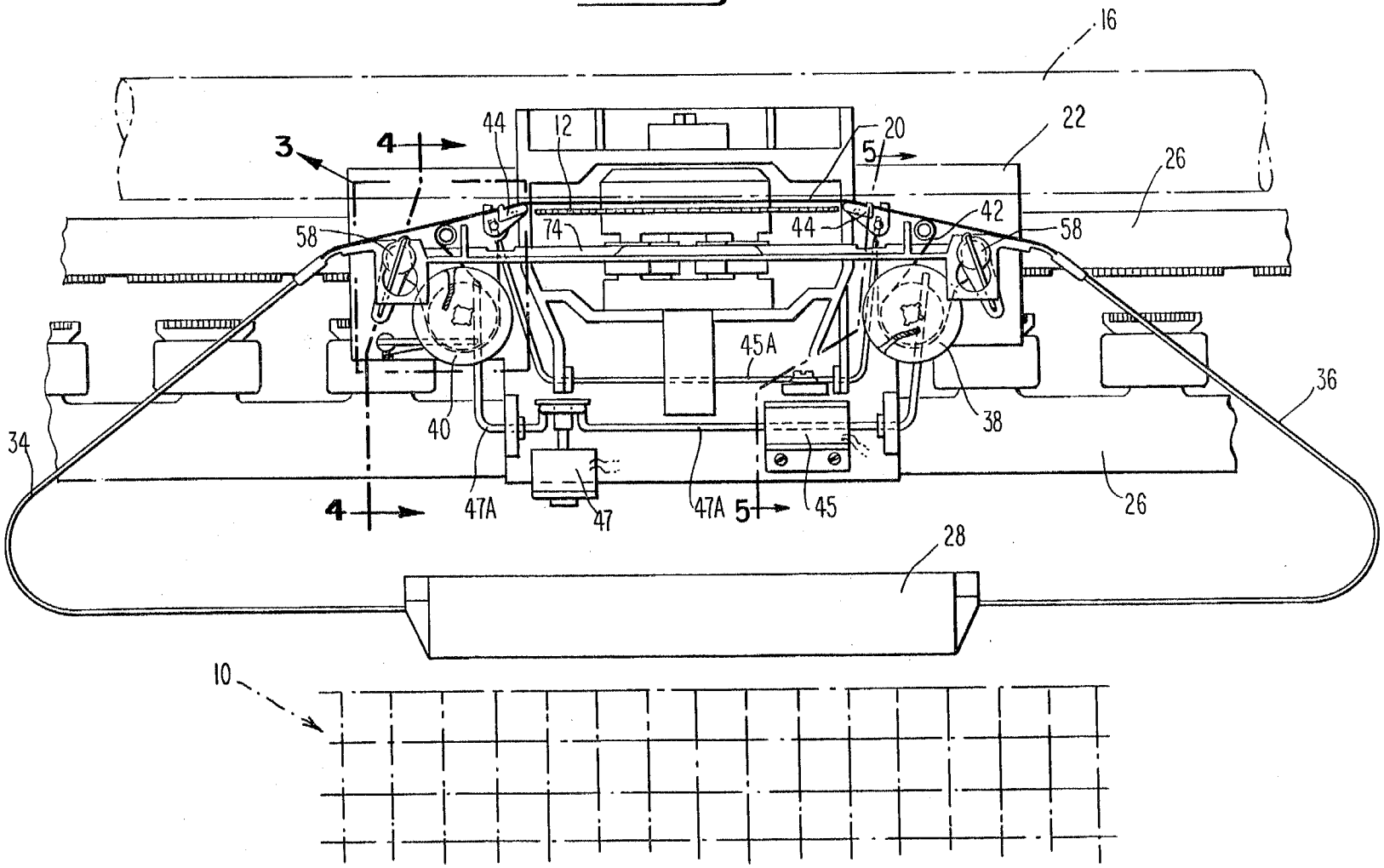
FIG. 2 is a top view of the printer shown in FIG. 1.

A printer comprising a typewriter shown in FIGS. 1 and 2 includes a keyboard 10 having a multiplicity of keys corresponding to various characters which, upon depression, control the position of a rotatable character array in the form of a print wheel or daisy 12 juxtaposed between inpact means in the form of a hammer 14 and a platen 16. The platen 16 is adapted to support a print receiving medium in the form of paper 18 which is contacted by the marking medium in the form of a print ribbon 20 which is located between the print wheel 12 and the paper 18 so as to leave a mark in ink corresponding to the particular character of the print wheel 12 which is in position between the hammer 14 and the paper 18.

As shown in FIG. 1, the print wheel 12 and the hammer 14 are mounted on a carriage 22 which is adapted to move in a lateral direction parallel with the surface of the platen 16 so as to position the print wheel 12 at various positions along the paper 18 in response to the depression of keys on the keyboard 10. As the carriage 22 is moved, the print wheel 12 rotates so as to position the proper character element at the end of a radially extending spoke in a printing position aligned with the print hammer 14. The lateral movement of the carriage 22 along the support surfaces 26 may be achieved by various means known in the art including a linear stepper motor such as that shown in copending application of Matthias and Thornton Ser. No. 833,271, filed Sept. 14, 1977, assigned to the assignee of this invention.

In accordance with copending application of Matthias Ser. No. 833,270, filed Sept. 14, 1977, assigned to the assignee of this invention, the print ribbon 20 is stored within a housing of a stationary cartridge 28 which is received, by a pocket 30, in an integrally molded receptacle 32. As shown in FIG. 1, the ribbon path length between the print point as determined by the position of the carriage 22 and the cartridge 28 is maintained constant over a substantial portion thereof by a first flexible leader 34 which extends from the cartridge 28 to the carriage 22 and a second flexible leader 36 which extends from the carriage 22 to the cartridge 28.

Between the first flexible leader 34 and the second flexible leader 36 a segment of the ribbon 20 is exposed and this segment is to be positioned adjacent the print point.

As more clearly pointed out in copending application of Muller and Rello Ser. No. 833,269, filed Sept. 14, 1977, assigned to the assignee of this invention, situated within the carriage 28 is a supply reel and a take-up reel (not shown) upon which the print ribbon 20 is wound. Further, a drive means (not shown) is associated with the supply reel and the take-up reel so as to continuously supply a fresh segment of ribbon 20 to the print point.

In addition to the hammer 14, the carriage 22 also supports and transports an erase ribbon supply reel 38 and an erase ribbon take-up reel 40. Wound around the erase ribbon supply reel 38 and positioned adjacent but below the print point is an erase ribbon 42 which may be used to remove characters which have been formed on the paper 18 by the print ribbon 20.

In accordance with the present invention, a mechanism for raising the ink or print ribbon 20 and the erase ribbon 42 from their respective rest positions below the print point to their operating positions within the reciprocating path of the hammer 14 is provided. Ribbons 20 and 42 are raised and lowered in order that the operator of the printer may observe each character after it has been formed on the print receiving medium 18.

When the printer is operating in its print mode, the print ribbon 20 is elevated to its operating position when a key of the keyboard 10 is depressed. However, the erase ribbon 42 is elevated to its operating position only when the printer is operating in an erase mode. At all other times, the print ribbon 20 and the erase ribbon 42 are maintained in their rest positions below the print point.

The mechanism for raising the ribbons 20 and 42 is supported on and transported by the carriage 22. The present invention is characterized by the fact that in their respective rest positions, the print ribbon 20 and the erase ribbon 42 are substantially vertically arranged with respect to one another. Further, in the preferred embodiment, the ribbons 20 and 42 are in the same plane when in their rest positions.

Figure 3:
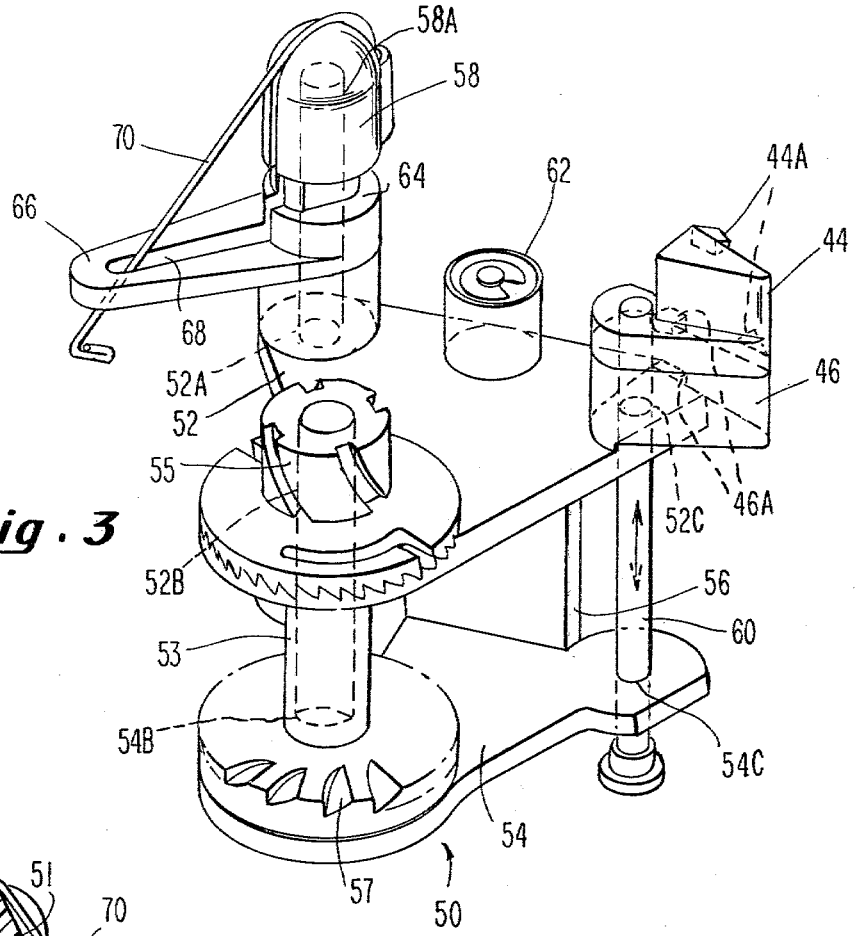
FIG. 3 is a perspective view of a ribbon mounting and lifting unit which has been shown generally outlined by a dotted portion 3 of FIG. 2.
Figure 4:
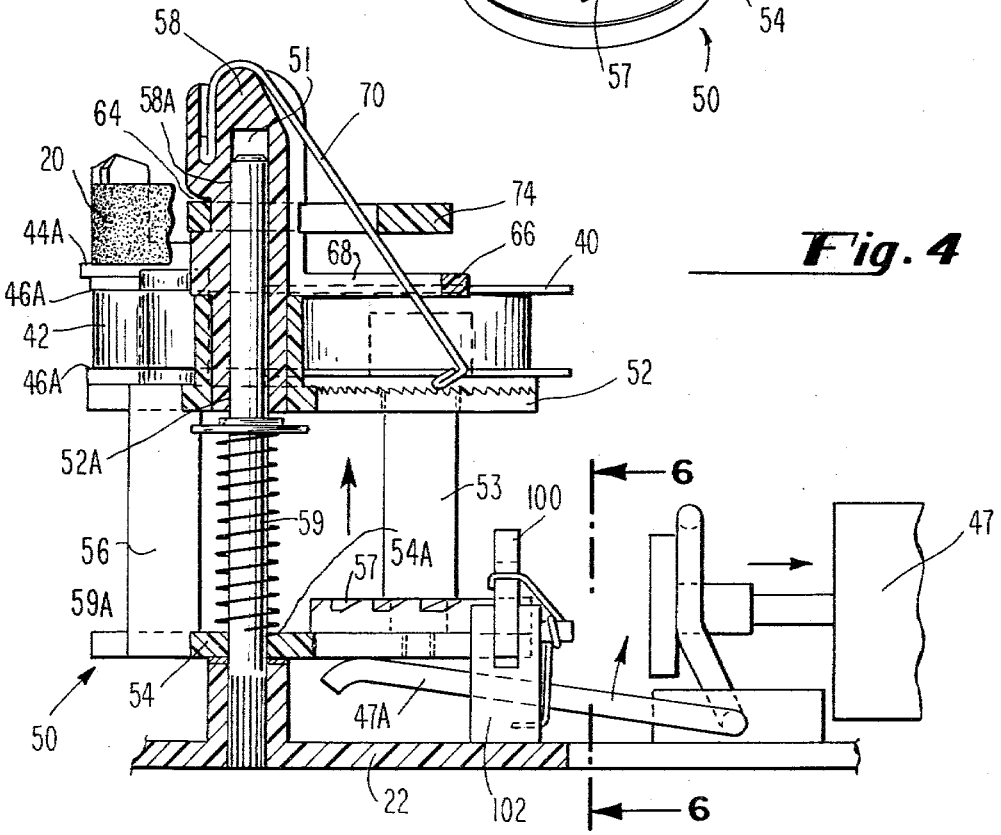
FIG. 4 is a cross-sectional view taken along line 4—4 of FIG. 2.

The print ribbon 20 is elevated to its operating position by means of a pair of print ribbon lifters 44, one of which may best be seen from FIG. 3. The erase ribbon 42 is elevated to its operating position by means of a pair of erase ribbon lifters 46. In the preferred embodiment, the print ribbon lifters 44 are situated directly above the erase ribbon lifters 46. The lifters 44 and 46 each contain notches 44A and 46A respectively which cradle the ribbons 20 and 42 as shown in FIG. 4. Between them, the print ribbon lifters 44 define a portion of the print ribbon path as the print ribbon 20 moves between the flexible leaders 34 and 36. Further, between the erase ribbon lifters 46, a portion of the erase ribbon path is also defined. As mentioned above, when the print ribbon 20 and the erase ribbon 42 are in their rest positions, the ribbons 20 and 42 are in vertical relationship to one another and preferably their paths are parallel.

Figure 5:
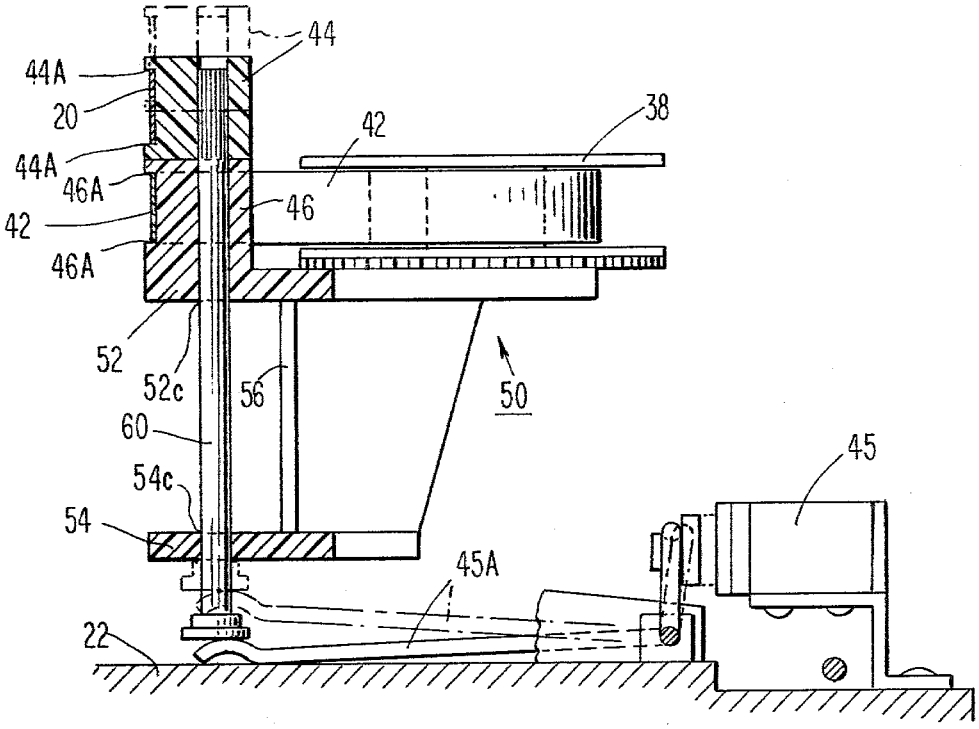
FIG. 5 is a cross-sectional view taken along line 5—5 of FIG. 2.

The print ribbon lifters 44 are elevated by means of a print ribbon lift magnet 45 and its associated linkage 45A (FIG. 2 and FIG. 5). The erase ribbon lifters 46 are elevated my means of an erase ribbon lift solenoid 47 and its associated linkage 47A (FIG. 2 and FIG. 4). The lifters 44 and 46 are supported on a pair of raisable brackets, one of which, shown generally at 50, may best be seen in perspective in FIG. 3 or in cross-section in either FIG. 4 or FIG. 5. As will be more fully explained below, when the printer is operating in the print mode, the print ribbon lifters 44 are raised to the print point elevation by the print ribbon lift magnet 45 while the brackets 50 remain stationary. However, when the printer is operating in the erase mode, the brackets 50 are raised by the erase ribbon lift solenoid 47, thus carrying the erase ribbon lifters 46 and the print ribbon lifters 44 with them.

In the preferred embodiment, each bracket 50 comprises a first planar surface 52 and a second planar surface 54 which are substantially parallel to one another and spaced apart by means of a vertical support 56. Both the planar surfaces 52 and 54 are pierced by a plurality of apertures 52A, 52B, and 52C and 54A, 54B and 54C respectively.

Covering the aperture 52A is an upwardly extending pier 58 which is integral with the bracket 50. The pier 58 contains a bore 58A therein which is slidably mounted over a stationary pin 59 (FIG. 4) which is attached to and transported by the carriage 22 and which also passes through the aperture 54A in the second planar surface 54.

In the preferred embodiment, the pier 58 is formed to have a generally cylindrical shape having a first outside diameter. However, as shown in FIG. 3, the pier 58 has a region of generally reduced diameter 64 below which is an outwardly extending flange 66. The flange 66 contains a slot 68. A spring 70 fastened to the top of the pier 58 as shown, extends through the slot 68 and is fabricated such that at the slot 68, it is biased away from the pier 58. As set forth in copending application of Hatsell Ser. No. 833,352, filed Sept. 14, 1977 assigned to the assignee of this invention, a ribbon bridge assembly 74 is mounted to the piers 58 such that the print ribbon 20 may be easily located in its rest position at which the bridge 74 is nested in the region 64 of reduced diameter of the pier 58.

Passing through the apertures 52C and 54C of each bracket 50 is a shaft 60 (FIG. 3). The shaft 60 passes through and is unattached to the erase ribbon lifter 46, however the shaft 60 is fixedly mounted to the ink ribbon lifter 44, such that a movement of the shaft 60 will be imparted to the print ribbon lifter 44 but not to the erase ribbon lifter 46. Activation of the print ribbon magnet 45 causes its associated linkage 45A to elevate the shaft 60 and thus the print ribbon lifter 44 to the print point as shown in phantom in FIG. 5. Activation of the erase ribbon solenoid 47 and its associated linkage 47A (FIG. 4) causes each of the brackets 50 to slide along the stationary pins 59 and into the erase ribbon operating position. As may be appreciated from FIG. 4, when the brackets 50 are elevated, both the print ribbon lifters 44, and the erase ribbon lifters 46 as well as the erase ribbon supply and take-up reels 38 and 40 respectively are elevated.

The present mounting and lifting assembly is advantageous in that when the printer is operating in the print mode, only the relatively lightweight print ribbon lifters 44 may be elevated. It is only when the printer operates in the more rarely used erase mode that the relatively heavier raisable brackets 50 must be elevated.

Passing through the apertures 52B and 54B of the raisable bracket 50 is a spindle 53, the uppermost portion 55 of which comprises a means around which either the erase ribbon supply reel 38 or the erase ribbon take-up reel 40 rotate.

Further, each of the planar surfaces 52 is provided with an erase ribbon spindle member 62 which maintains the erase ribbon 42 in tension as it proceeds from the erase ribbon supply reel 38 to the erase ribbon take-up reel 40.

Figure 6:
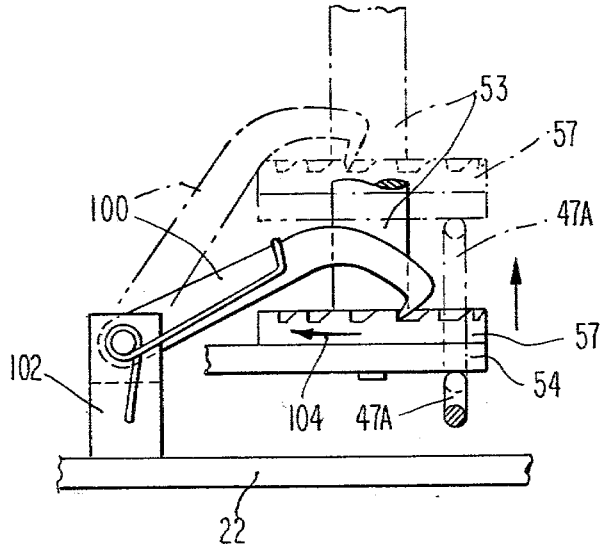
FIG. 6 is a sectional view taken along line 6—6 of FIG. 4 showing a means for advancing an erase ribbon when the printer is operated in an erase mode.

Those skilled in the art will of course realize that a means must be provided to advance the erase ribbon 42 as the printer of the present invention is operated in an erase mode. Accordingly, on the side of the printer on which the erase ribbon take-up reel 40 is found, the bottom portion 57 of the spindle 53 is ratcheted such that a pawl 100 (FIG. 6) mating with the ratchet will impart a rotational movement to the take-up reel 40. The pawl 100 is pivoted on a pillar 102 which is rigidly mounted on the carriage 22. When the erase ribbon lift solenoid 47 is activated, and the linkage 47A is raised, the spindle 53 is rotated in the direction of arrow 104. In this manner, the vertical motion of the raisable bracket 50 is translated to a rotational motion which causes the erase ribbon take-up reel 40 to revolve which in turn causes the advance of the erase ribbon 42.

Although a particular embodiment has been shown and described, various modifications may be made which fall within the true spirit and scope of the invention as set forth in the appended claims.

What is claimed is:

1. An assembly for elevating a print ribbon and an erase ribbon to the print point of an impact printer, both said print ribbon and said erase ribbon being normally located at a rest position near said print point, said assembly comprising:

a pair of print ribbon lifters, one of said print ribbon lifters being positioned on each side of said print point, said print ribbon lifters defining a print ribbon path therebetween;

a pair of erase ribbon lifters, one of said erase ribbon lifters being positioned on each side of said print point, said erase ribbon lifters defining an erase ribbon path therebetween, said erase ribbon path and said print ribbon path being substantially vertically arranged with respect to one another when said ribbons are in their rest positions;

a first means for selectively elevating one pair of said lifters without disturbing the other pair of said lifters whereby one of said ribbons is intermittently positioned adjacent said print point and returned to said rest position; and a second means for selectively elevating said other pair of lifters whereby the other of said ribbons is intermittently positioned adjacent said print point and returned to said rest position.

2. The assembly of claim 1 wherein said printer comprises a printer having a daisy type character element.

3. The assembly of claim 1 wherein said first means elevates said print ribbon lifters and wherein said second means elevates said erase ribbon lifters.

4. The assembly of claim 3 wherein said second means also elevates said print ribbon lifters to a position above said print point.

5. The assembly of claim 1 wherein said ribbon paths are substantially parallel to one another when said ribbons are in said rest positions.

6. The assembly of claim 5 wherein said ribbon paths are coplanar when said ribbons are in said rest position.

7. The assembly of claim 1 wherein said print ribbon lifters and said erase ribbon lifters are supported on a pair of raisable brackets wherein elevation of said brackets is imparted to both said print ribbon lifters and to said erase ribbon lifters.

8. The assembly of claim 7 wherein said print ribbon lifters are each fastened to a shaft passing through said brackets and wherein elevation of said shaft is imparted to said print ribbon lifters but not to said brackets.

9. The assembly of claim 8 wherein each of said brackets supports a spindle, a first one of said spindles being capable of receiving an erase ribbon supply reel and a second one of said spingles being capable of receiving an erase ribbon take-up reel.

10. The assembly of claim 9 wherein said second spindle is provided with ratchet means for rotating said take-up reel when the bracket on which said second spindle is mounted is elevated.

11. A method of operating a printer having a print point in a print mode and an erase mode comprising the steps of:

positioning a print ribbon at a first rest position near the print point of said printer;

positioning an erase ribbon at a second rest position near said print point, said print ribbon and said erase ribbon being substantially coplanar when in said rest positions;

selectively changing the position of one of said ribbons without disturbing the other of said ribbons whereby one ribbon is intermittently positioned adjacent said print point; and selectively changing the position of the other of said ribbons whereby said other ribbon is positioned adjacent said print point.

12. The method of claim 11 whereby said position changing steps comprise elevating said ribbons to a point adjacent said print point.

13. The method of claim 12 further comprising the step of elevating said one ribbon to a point above said print point simultaneously with the elevation of said other ribbon to said print point.

* * * * *